United States Patent [19]

Chapman

[11] 4,139,034

[45] Feb. 13, 1979

[54] WAFERIZER

[75] Inventor: Frederic F. Chapman, Coquitlam, Canada

[73] Assignee: Hawker Siddeley Canada Ltd., Toronto, Canada

[21] Appl. No.: 864,214

[22] Filed: Dec. 27, 1977

[30] Foreign Application Priority Data

Feb. 15, 1977 [GB] United Kingdom ..... 6205/77

[51] Int. Cl.[2] ..... B27C 1/00

[52] U.S. Cl. ..... 144/172; 144/42; 144/230; 144/174

[58] Field of Search ..... 144/40, 42, 43, 159, 144/162 R, 172, 173, 176, 323, 326 A, 326 B, 326 C, 326 D, 230, 174

[56] References Cited

U.S. PATENT DOCUMENTS

| | | | |
|---|---|---|---|
| 2,876,811 | 3/1959 | Matthews | 144/42 X |
| 3,000,412 | 9/1961 | Jaschke | 144/42 X |
| 3,017,912 | 1/1962 | Sybertz et al. | 144/42 X |
| 3,882,912 | 5/1975 | Sybertz | 144/172 |

FOREIGN PATENT DOCUMENTS

| | | | |
|---|---|---|---|
| 289910 | 2/1971 | U.S.S.R. | 144/43 |

*Primary Examiner*—Othell M. Simpson
*Assistant Examiner*—W. D. Bray
*Attorney, Agent, or Firm*—Carver and Company

[57] ABSTRACT

A waferizer having a rotatable cylindrical head from which a plurality of waferizing knives project for slicing wood stock, and rollers mounted on the head which have a plurality of longitudinally extending radially projecting blades for incising the face of the wood stock to a depth equal to the depth of cut of the knives so as to produce wafers of uniform width.

6 Claims, 3 Drawing Figures

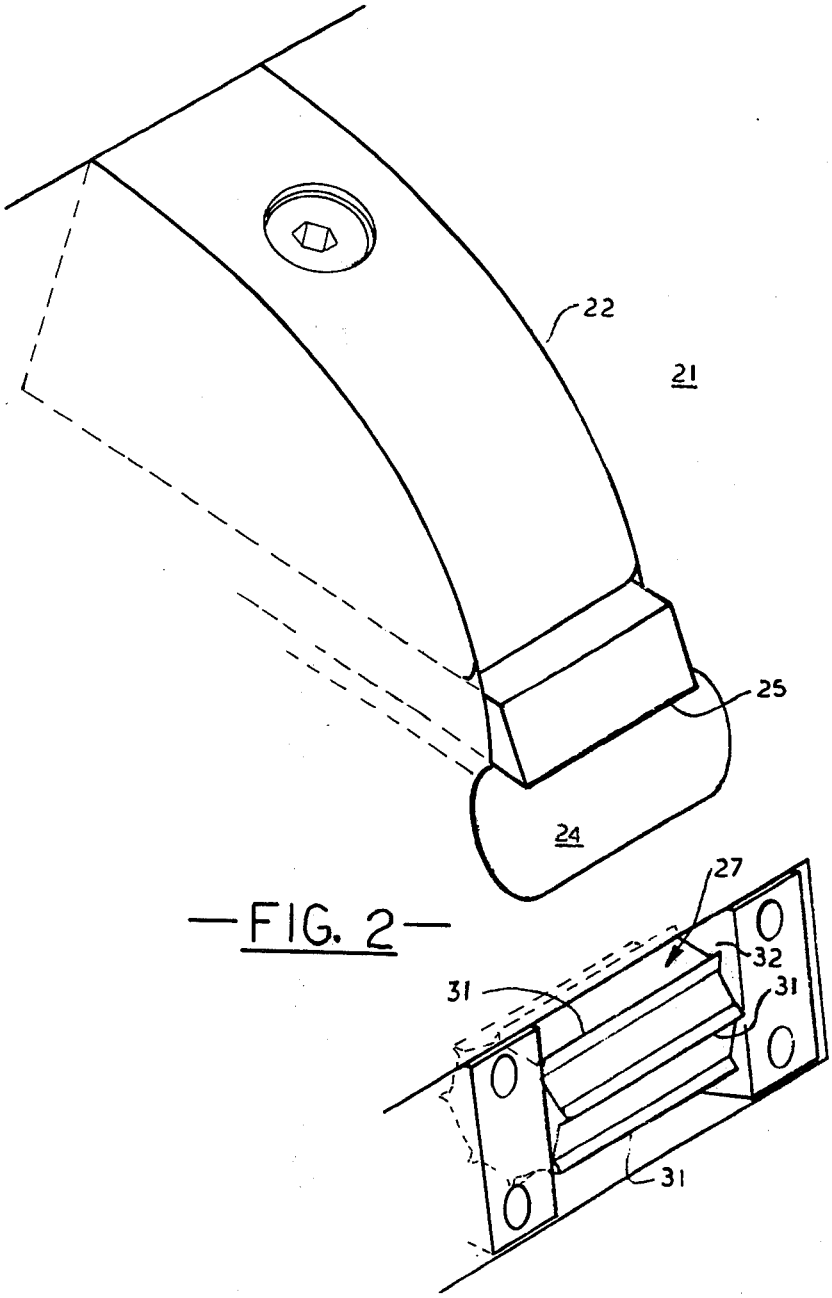
—FIG. 2—

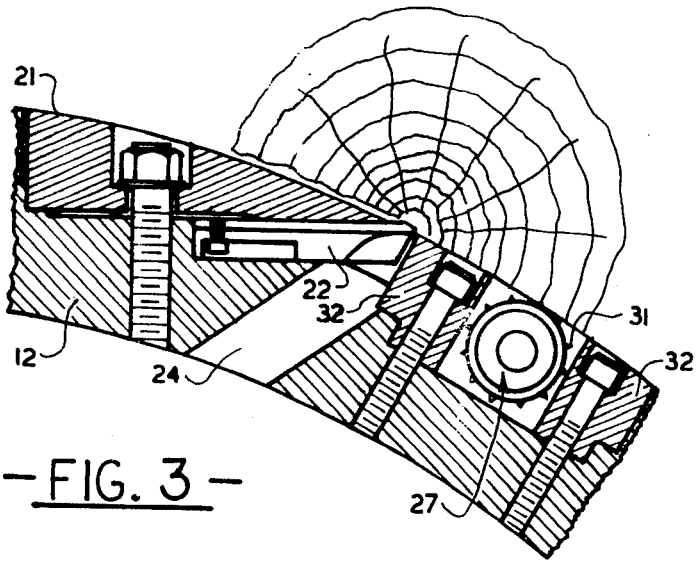
-FIG. 3-

WAFERIZER

BACKGROUND OF THE INVENTION

1. Field of the Invention

This invention relates to machines for producing wafers from wood stock to be used in production of wafer board and in particular to a wafer production head therefore.

2. Prior Art

In the production of wafers for wafer board production, equipment generally referred to as waferizers, commonly embody a rotating cylindrical drum having projecting knives against which the wood stock such as short lengths of log is pressed and thus reduced to wafers. Wafers so produced are usually of the same length and thickness, however, they vary considerably in width as the cards which are sliced from the wood stock and are subsequently tumbled and ejected from the drum are subject to random cleavage.

Waferizing equipment has been developed recently which enables production of wafers of uniform dimension, and which thus enables selective orientation of the wafers relative to the fibre direction so as to thereby obtain some control of the structural characteristics and appearance of wafer board ultimately produced. In such equipment the cards as they are sliced from the wood stock are clipped or cut into wafers of equal width by centrifugally expelling them through clipping boxes.

SUMMARY OF THE INVENTION

The present invention provides a waferizer which can produce wafers of uniform dimension yet which does not have the restrictions of feed and operating tolerances required of the prior art waferizers of this type.

The waferizer of the present invention has a driven rotatable cylindrical drum, waferizing knives projecting from the cylindrical face of the drum and incising rollers mounted on the drum in advance of and in alignment with the waferizing knives, the incising rollers having longitudinally extending knives for penetrating the face of the wood stock prior to engagement of the wood stock by the waferizing knives established maximum wafer width.

A detailed description following, related to drawings, gives exemplification of apparatus according to the invention which, however, is capable of expression in means other than those particularly described and illustrated.

DESCRIPTION OF THE DRAWINGS

FIG. 2 is an enlarged perspective view of a portion of the waferizing equipment showing disposition of a knife and an incisor, FIG. 3 is a transverse section of a portion of a waferizng head.

DETAILED DESCRIPTION

Figure 1:
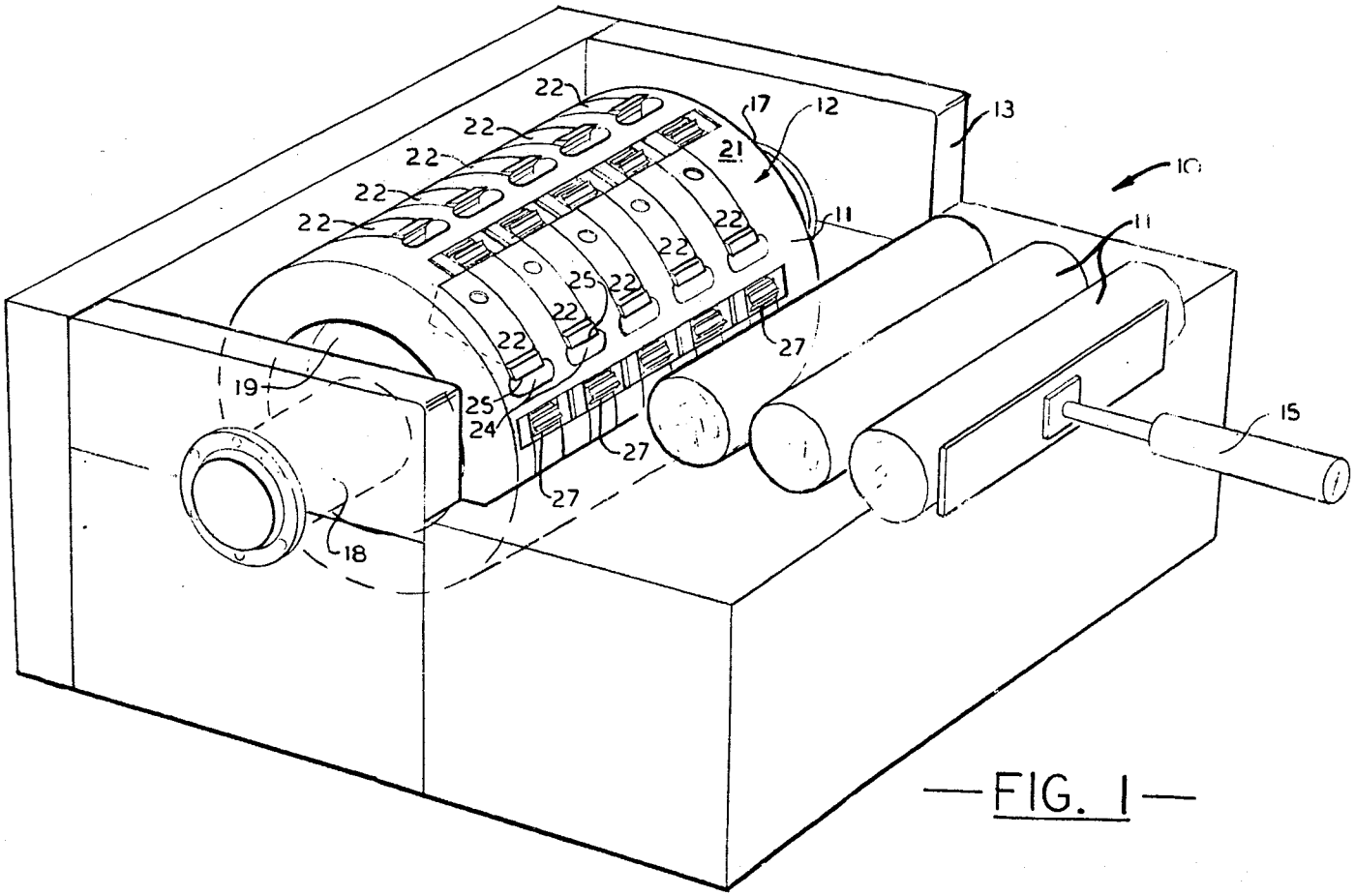
FIG. 1 is a perspective view of waferizing equipment in accordance with the invention.

Referring to the drawings, FIG. 1 shows a known waferizer 10 for reducing wood stock 11 such as short sections of logs which, normally, are not suitable for production of dimensioned lumber. This type of waferizer has a rotatable knife carrying waferizing head 12 which is mounted for rotation on a supporting frame 13 and charging mechanism, generally 15, which is operable to thrust the logs 11 against the head for reduction to wood wafers for use in manufacture of wafer board. Neither the supporting frame nor the charging mechanism are shown in detail as methods and means of mounting waferizing heads and charging mechanisms are well known in the industry.

The head 12 conventionally is a cylindrical drum having a closed end 17 cantlever mounted at said end on a drive shaft 18 which is supported for rotation in the frame 13, the opposite end 19 of the head being open and clear of the frame. The head has a smooth cylindrical outer surface 21 and has mounted therein, in a known manner (see FIG. 2), a plurality of knives, serverally 22, which project slightly from the outer surface 21 a distance equal to the desired wafer thickness. The head has wafer passages 24 at each knife through which wood wafers when cut, pass into the head. Knife edges 25 of the knives extend parallel to rotational axis of the head so as to cut parallel to the grain of the logs. Baffles (not shown) are disposed inside the head for directing and ejecting the wafers out of its open end 19.

The knives are arranged in rows, two rows only being shown, which are circumferentially spaced apart and the knives of each row are in staggered relationship to the knives of the rows immediately preceeding and following. Furthermore, the knives of each row are equidistantly spaced apart a distance equal to the width of the knives of the rows adjacent. The number of rows is generally determined by the diameter and rotational speed of the drum.

In accordance with the invention, the head has mounted thereon in advance of each knife, incisors, severally 27, which penetrate the face of th wood stock being reduced to wafers, prior to engagement of the wood stock by the waferizing knives with which each incisor is associated.

Referring particularly to FIGS. 2 and 3, wherein a waferizing knife and incisor are shown, each incisor takes the form of a cylindrical roller the length of which is substantially the same as the length of the cutting edges of the waferizing knives and has a plurality of radially projecting and longitudinally ending incising blades 31. The incising blades are uniformly spaced apart, the spacing between adjacent incising blades being equal to the desired wafer width. The incisors are mounted in bearing blocks 32 bolted in sockets 33 in the head for rotation on axes parallel to the rotational axis of the drum and are positioned so that as each incisor is rotated the imaginary cylinder generated by the incising blades projects beyond the outer surface of the head a distance equal to desired wafer thickness.

It is to be understood that in some circumstances it is not necessary to use an incisor for each waferizing knife. For soft woods one incisor can be used for a plurality of following waferizing knives, in which event the incisor would be adjusted so that the incising blades project from the surface of the drum a distance equal to the sum total of the depths of cut of the waferizing knives between incisors. In harder woods, however, where penetration is more difficult and where damage to wood might result one incisor is generally required in advance of each waferizing knife.

In operation, pressure applied by the charging mechanism is sufficient to maintain the log being waferized in intimate engagement with the smooth outer surface of the head so that as the incisors meet the log they automatically rotate so that the incising blades penetrate the face of the log to be sliced by the waferizing knives following. As each waferizing knife then mades its cut none of the wafers produced will be wider than the circumferential distance between adjacent incisor blades. It is seen that other than the two wafers at each end of the cut substantially all of the wafers will be of the same width.

I claim:

1. In a waferizer of the type having a rotatable head having a cylindrical face and a plurality of knives projecting from the said face for reducing wood stock pressed thereagainst to wafers; incising means for continuously establishing lines of severence across the face of the wood stock in advance of each knife so as to result in production of wafers of selected widths, said means comprising:

a. a cylindrical roller mounted in the head in advance of and in circumferential alignment with a selected number of circumferentially aligned knives for rotation about an axis parallel to axis of rotation of the head, b. a plurality of circumferentially spaced apart, longitudinally extending incising blades projecting radially from the roller, said roller being mounted so that each blade, as the roller rotates, has a maximum projection from the cylindrical face of the head a distance equal to the sum total of depth of cut of the selected knives with which each roller is associated.

2. Incising means as claimed in claim 1 in which the incising blades are equidistantly spaced apart so as to provide wafers of uniform width.

3. Incising means as claimed in claim 1 in which an incising roller is mounted in advance of each waferizing knife.

4. A waferizer comprising:

a. a driven rotatable head having a cylindrical face, b. feed means for urging a length of wood stock against the cylindrical head face, c. a plurality of waferizing knives secured to the head and projecting from the face thereof for engaging and slicing wood from the wood stock, d. incising means for continuously establishing lines of severence across the face of the wood stock in advance of each knife so as to result in production of wafers of selected widths, said means including:

i. a cylindrical roller mounted on the head in advance of and in circumferential alignment with a selected number of circumferentially aligned knives for rotation about an axis parallel to axis of rotation of the head, ii. a plurality fo circumferentially spaced apart, longitudinally extending incising blades projecting radially from the roller, said roller being mounted so that each blade, as the roller rotates, has a maximum projection from the cylindrical face of the head a distance equal to the sum total of depth of cut of the selected knives with which each roller is associated.

5. A waferizer as claimed in claim 1 in which the incising blades are equidistantly spaced apart so as to provide wafers of uniform width.

6. Incising means as claimed in claim 4 in which an incising roller is mounted in advance of each waferizing knife.

* * * * *